United States Patent [19]

Graham et al.

[11] Patent Number: 4,812,721

[45] Date of Patent: Mar. 14, 1989

[54] WIRE DRAWING CONTROL APPARATUS

[75] Inventors: Randall C. Graham, Nashville; James D. Smith, Jr., Fairview; Jeffrey S. Smith, Franklin, all of Tenn.

[73] Assignee: Essex Group, Inc., Fort Wayne, Ind.

[21] Appl. No.: 101,230

[22] Filed: Sep. 25, 1987

[51] Int. Cl.[4] ..... H02P 5/46; B21C 1/12

[52] U.S. Cl. ..... 318/66; 318/59; 318/77; 72/286; 72/288

[58] Field of Search ..... 318/51, 59, 66, 67, 318/68, 77; 242/47.01, 47.02, 78, 75.5, 75.51; 72/39, 43, 278, 279, 280, 281, 286, 288, 289

[56] References Cited

U.S. PATENT DOCUMENTS

| | | | |
|---|---|---|---|
| 2,557,215 | 6/1951 | Bruestle | 72/286 |
| 3,506,863 | 4/1970 | Fallis | 318/6 X |
| 3,813,908 | 6/1974 | Miglore | 72/21 X |
| 3,822,575 | 7/1974 | Hoorelbeke | 72/288 |
| 3,842,643 | 10/1974 | Large et al. | 72/286 |
| 3,898,436 | 8/1975 | Pottebaum et al. | 242/75.51 |
| 4,662,203 | 5/1987 | Kanatani et al. | 72/288 X |

*Primary Examiner*—Bentsu Ro

*Attorney, Agent, or Firm*—Francis J. Maguire, Jr.

[57] ABSTRACT

In a magnet wire fabrication process in which the drawing of wire is "in-line" with the enameling process, it is often a requirement that the drawing machines be supplied with electrical power from the utility grid rather than relying on an "in-house," closely regulated supply of electrical power. In such cases, during voltage dips on the grid, the drawing machine motors will slow down while the wires continue to be pulled from the drawing machine at the same speed as before. A wire accumulator is interposed between the drawing machines and the enameling oven to prevent breakage of wire by providing an accumulation of wire to be used in the event of such a voltage dip. The present invention discloses an apparatus for controlling the various channels of the accumulator so as to provide roughly equivalent amounts of wire in each channel so that the integrity of all channels during a power dip is assured. A central operator control station for effecting the desired control is disclosed. It comprises, among other things, a keyboard and a display for entering a desired wire gauge size to be drawn, and a signal processor for controlling the accumulator channels according to the commanded gauge size. A plurality of controllers for each channel are responsive to a speed command signal from a pulling capstan at the enameling end of the process. This signal is modified by a feedback signal derived from the accumulator channels so as to indicate the actual running speed of the various drawing machine motors and at the same time control the amount of wire accumulated in the various channels.

1 Claim, 4 Drawing Sheets

| WIRE GAUGE | AIR PRESSURE (PSI) |
|---|---|
| 12 | 49 |
| 13 | 39 |
| 14 | 31 |
| 15 | 24 |
| 16 | 19 |
| 17 | 15 |
| 18 | 12 |
| 19 | 10 |
| 20 | 8 |
| 21 | 6 |
| 22 | 5 |
| 23 | 4 |
| 24 | 3 |

WIRE DRAWING CONTROL APPARATUS

TECHNICAL FIELD

This invention relates to wire drawing machines and, more particularly, to an apparatus for controlling the speed thereof.

BACKGROUND ART

Magnet wire insulation consists of enamel baked on bare copper wire. The wire is enameled by dipping the wire in liquid enamel, baking, redipping and rebaking repeatedly until the desired electrical insulation and mechanical properties are achieved.

A standard practice in the prior art is to select the desired wire gauge to be enameled and have a large quantity of the desired gauge wire predrawn and placed on hand and available for fabrication. Recently, it has become the practice in the assignee's magnet wire fabrication plants to provide "in-line" drawing machines for drawing wire simultaneously with the fabrication process. Baskets of heavy gauge wire feed drawing machines which draw wire down to the desired gauge. The wire is then passed through an annealer and then dipped and baked prior to spooling. All of these processes take place in a single fabrication line.

A large number of "in-line" fabrication lines have been established at assignee's fabrication plant. Because of the criticality of the enameling process, involving closely controlled temperatures and airflows for curing the enamel, an external supply of electrical power for pulling the wire through the enameling process cannot be depended upon. Therefore, an in-house generator is utilized to provide closely regulated electrical power for the pulling of wire through the dipping and baking process.

On the other hand, electrical power for the drawing machine variable speed motors cannot be economically supplied in-house because of the very large power demand.

Because of the "in-line" character of the production process it will be seen that if there is a "dip" in the voltage supplied by the utility for driving the wire drawing machines, there will be a slowdown in those motors which will in turn cause wire to be supplied to the enameling end of the fabrication process line in a not large enough quantity to remain sufficiently supplied. This is due to the steady character of the voltage supplied from the "in-house" generator which is not subject to the utility line dips in voltage.

Thus, unless there is a wire accumulator provided between the wire drawing end of the fabrication line and the enameling end of the line there may be a wire breakage during a utility line voltage dip.

In evolving an apparatus and method for controlling the speed of the wire drawing motors vis-a-vis the capstan motor (which pulls the wires in unison through the enameling end of the line), Applicant's assignee has, over the past few years, established a control principle based upon a "mixing" technique in which the speed of the pulling capstan at the enameling end is monitored and provided to the drawing end in order to use that signal as an indication of how fast the drawing machines should be running. However, because of component differences between variable speed motor drive controllers and motors, even if the same speed command signal is used for controlling each motor, there will be slight differences in the resulting speed of the various motors in a multiple wire drawing machine Therefore, the magnitude of the speed signal provided to each variable speed motor drive must be modified slightly to account for these differences. This may be handled by sensing the amount of wire accumulated in each of the channels of the accumulator. If the accumulator is accumulating a little bit too much wire it is a good indication that the speed of the drawing machine is a little bit too fast and an appropriately scaled signal can be fed back to modify the speed command signal so as to slow it down slightly. The same goes for the situation where the accumulator is accumulating not enough wire to withstand a utility voltage dip. In that case, the signal from the accumulator is used to slightly increase the speed of the drawing machine motor to provide a little bit more wire accumulation.

In this way, the proper amount of accumulated wire for each of the channels in the accumulator can be assured. This principle has been in use in assignee's plant for more than one year for producing wire in commercial quantities.

However, the circuitry for mixing the capstan speed signal and the accumulator signal is somewhat complex and needs to be adjusted for each of the lines individually by a technician using manual adjustments. This can be somewhat confusing for the technicians, many of whom are not schooled or equipped to make delicate electronic adjustments without error. Furthermore, each time the wire gauge is changed there is a necessity to provide more or less accumulation of wire because of the different speeds used to fabricate different gauges. This also requires manual adjustments, different from the previously mentioned adjustments, which gives rise to further confusion on the part of the technicians.

DISCLOSURE OF INVENTION

The object of the present invention is to provide a wire drawing machine speed control apparatus.

According to the present invention the speeds of a plurality of variable speed motors for drawing a plurality of wires to a gauge size indicated by an operator initiated gauge signal are individually and automatically controlled by the apparatus of the present invention. The apparatus controls the motors for drawing a plurality of wires in a fabrication line including a corresponding plurality of wire accumulator channels for accumulating wire provided by the motors. The fabrication line also includes an independently driven capstan for pulling all of the drawn wires from the accumulator into the enameling end of the process line. The apparatus comprises a plurality of accumulation sensors, one for each accumulator channel, for providing a corresponding plurality of accumulation signals having magnitudes indicative of the quantity of wire accumulated, a sensor responsive to the speed of the capstan for providing a capstan speed signal having a magnitude indicative thereof for commanding the speed of the variable speed motors, a plurality of controllers, each responsive to a selected one of the accumulation signals and to said capstan speed signal for providing a motor drive speed control signal for commanding the speed of a corresponding one of the variable speed motors, according to the magnitude of said capstan speed signal modified by said selected accumulation signal. The effect of the modification of the capstan speed signal by the selected accumulation signal is to increase the speed of the motor to a speed greater than that commanded by the capstan speed signal in response to an accumulation signal magnitude indicative of a deficiency of wire accumulation in the corresponding accumulator channel. Similarly, the speed of the variable speed motor is modified by the selected accumulation signal so as to decrease the speed of the motor to a speed lesser than that indicated by the magnitude of the capstan speed signal in response to an excess accumulation of wire in the accumulator channel. A signal processor is responsive to a gauge size signal provided by the operator for controlling the amount of accumulation of wire in the accumulator according to the magnitude of the gauge signal. This feature provides for the different accumulation requirements for different gauge wire.

Thus, the speeds of the independently driven variable speed motors are automatically controlled by the apparatus of the present invention thereby assuring that the proper amount of wire is accumulated for withstanding power interruption.

These and other objects, features and advantages of the present invention will become more apparent in light of the following detailed description of a best mode embodiment thereof, as illustrated in the accompanying drawing.

DESCRIPTION OF THE PREFERRED EMBODIMENT

Figure 1:
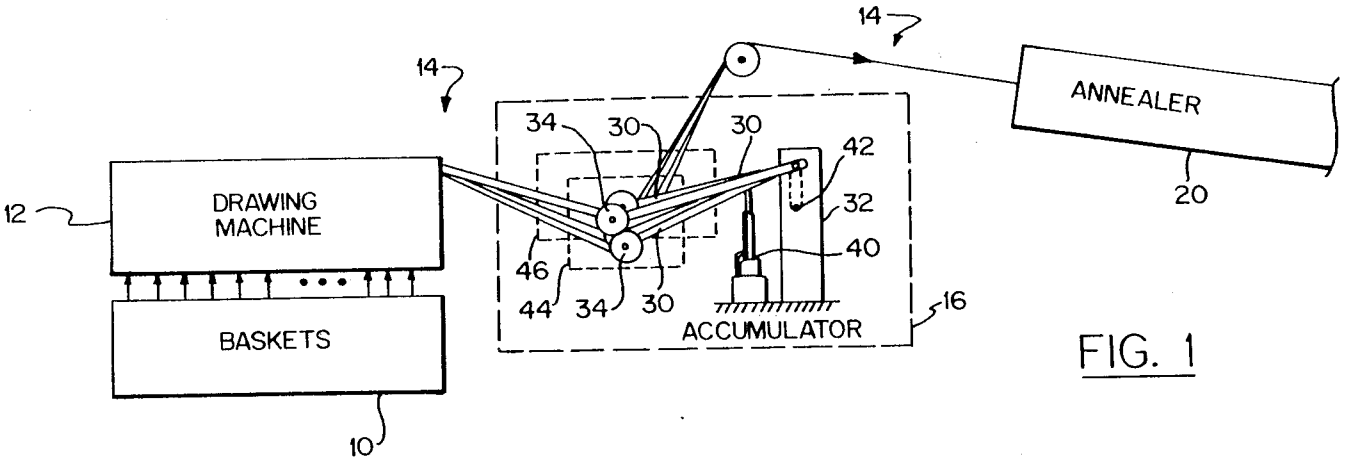
FIG. 1 is a partial illustration of a magnet wire fabrication process in which a wire drawing machine is "in-line" with an annealer and an enameling oven.

FIG. 1 is a partial illustration (which is continued in FIG. 2) of a magnet wire fabrication line including a plurality of heavy gauge wire baskets 10 which may typically be on the order of 12 gauge wire feeding a plurality of wires to a drawing machine 12. A plurality of variable speed motors, one for each of the wires fed from the baskets, are within the drawing machine and are controlled at a speed dictated by the gauge of wire being produced in the drawing machine. A plurality of smaller gauge wires are produced (drawn) and provided on a plurality of wire line 14 to an accumulator 16. The accumulator accumulates a sufficient amount of wire to give the fabrication line a certain amount of "play" in order to withstand speed variations between the drawing machine motors for supplying the wire and a capstan 18 motor for pulling the wire as shown in FIG. 2.

Figure 2:
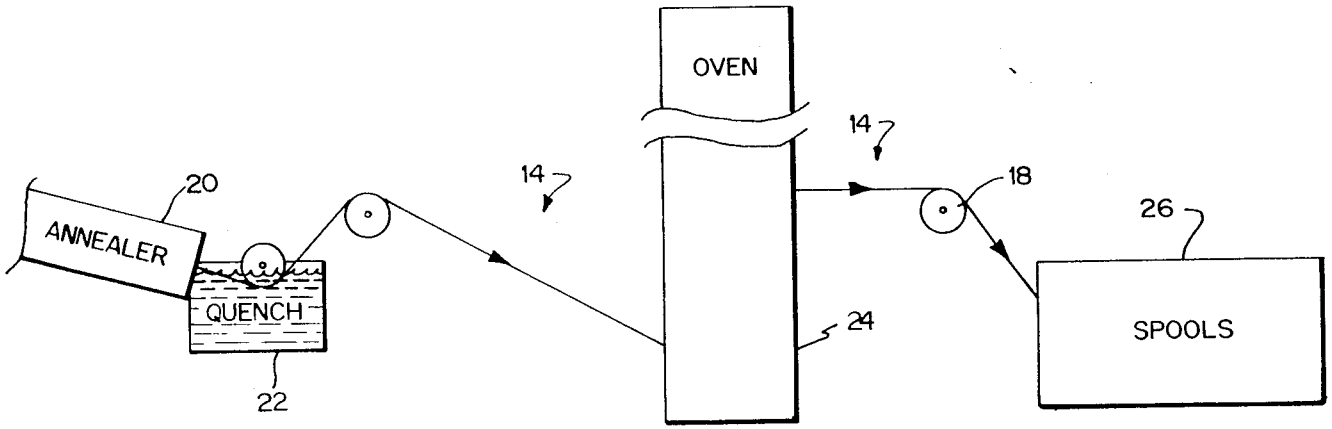
FIG. 2 is a continuation of FIG. 1, showing the remainder of the "in-line" drawing process.

After exiting the accumulator 16, the plurality of wires 14 are provided to an annealer 20 which includes a quench bath 22 at the exit thereof, as shown in FIG. 2. The annealed wire is then pulled by the capstan 18 into a baking oven 24 where it is dipped, baked, redipped and rebaked repeatedly until the desired electrical insulation and mechanical strength properties are imparted to the wire. Insulated magnet wire then exits the oven onto the capstan 18 where it is then wound onto spools 26 for delivery to commercial customers.

Referring back to FIG. 1, the accumulator may take many different forms but is shown in FIG. 1, without limitation, as being comprised of a plurality of "dancer arms," one for each wire being fabricated. Thus, for a 10 wire drawing machine there will be 10 dancer arms. The principle illustrated in the dancer arm accumulator 16 may be implemented in any number of different ways but generally comprises a plurality of arms 30 pivoted on a support structure 32. Each of the arms has a sheave 34 mounted at the end thereof for engaging one of the wires 14 pulled from the drawing machine by the capstan 18.

In order to maintain a certain amount of tension on the wires pulled from the drawing machine throughout the fabrication line, it is necessary to provide a tensioning device such as a plurality of air pistons 40, one for each dancer arm. These pistons are provided with an external air supply and pull down on the dancer arms once the capstan pulling process begins. The pistons receive an ordered air pressure externally from a remote regulator which is self-relieving and self-regulating at that ordered air pressure. The presence of this tensioning device ensures that the wires do not come off of the sheaves throughout the fabrication line, particularly within the oven.

Each of the dancer arms 30 has an associated sensor 42 associated with it which indicates the height of the dancer arm and hence the amount of wire accumulated in that particular accumulator channel. It is desirable to maintain a certain amount of available wire for withstanding a power dip during which the speed of the drawing machine motors will decrease while the speed of the capstan 18 remains the same. The desired amount for accumulation will change depending on the gauge of wire being fabricated due to the different fabrication speeds for different wire gauge sizes. For instance, for smaller gauge wire the fabrication process is faster and therefor more accumulated wire is needed in the accumulator for withstanding power dips. Thus, the dancer arms will have to be maintained at a lower level within, for example, the dashed lines 44. For a slower fabrication speed, for thicker wire, there will be a need for a lesser amount of accumulated wire and the height of the dancer arms may be maintained within, for example, a dashed box 46. In both cases the ordered air pressure to the pistons 40 is just sufficient to keep the wire on the sheaves throughout the fabrication line and is much less than that which would cause a break. It should be understood that more air pressure will be needed for thicker gauge wire while less air pressure will be needed for thinner gauge wire to hold down the dancer arm lower. Thus, by carefully selecting the operating height for the dancer arms, according to the gauge wire being fabricated, the exact amount of play required as opposed to the amount of air pressure resistance supplied will determine the height of the dancer arms at the breakpoint of the wires, which should be about the same for all gauges. In this way, the same amount of time can be provided for withstanding voltage dips for all wire gauges.

Figure 3A:
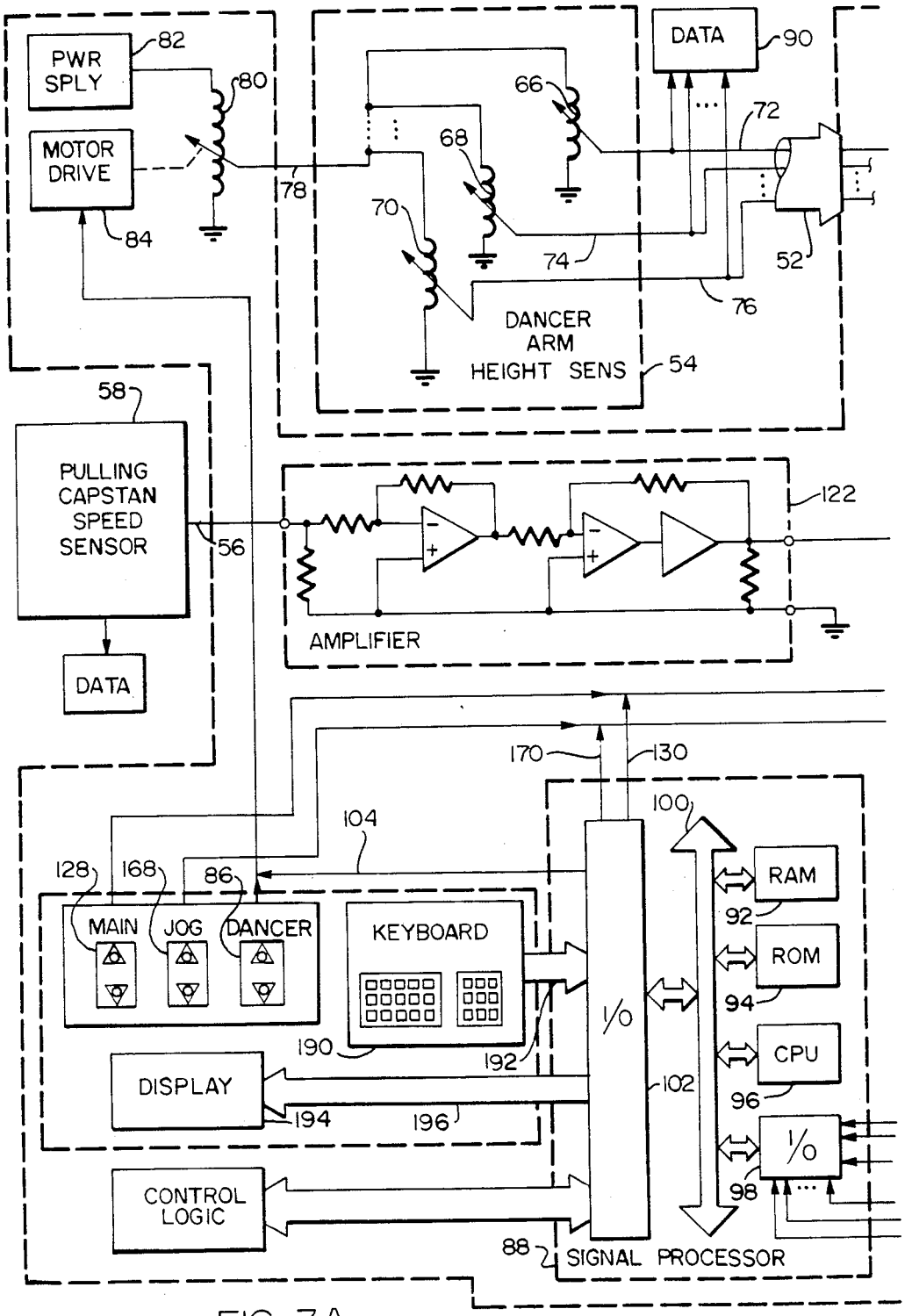
FIG. 3 is a composite figure of FIGS. 3A and 3B and is a simplified block diagram illustration of an operator control station responsive to accumulator signals and a capstan signal for automatically providing speed control signals, according to the present invention.
Figures 3, 3B:
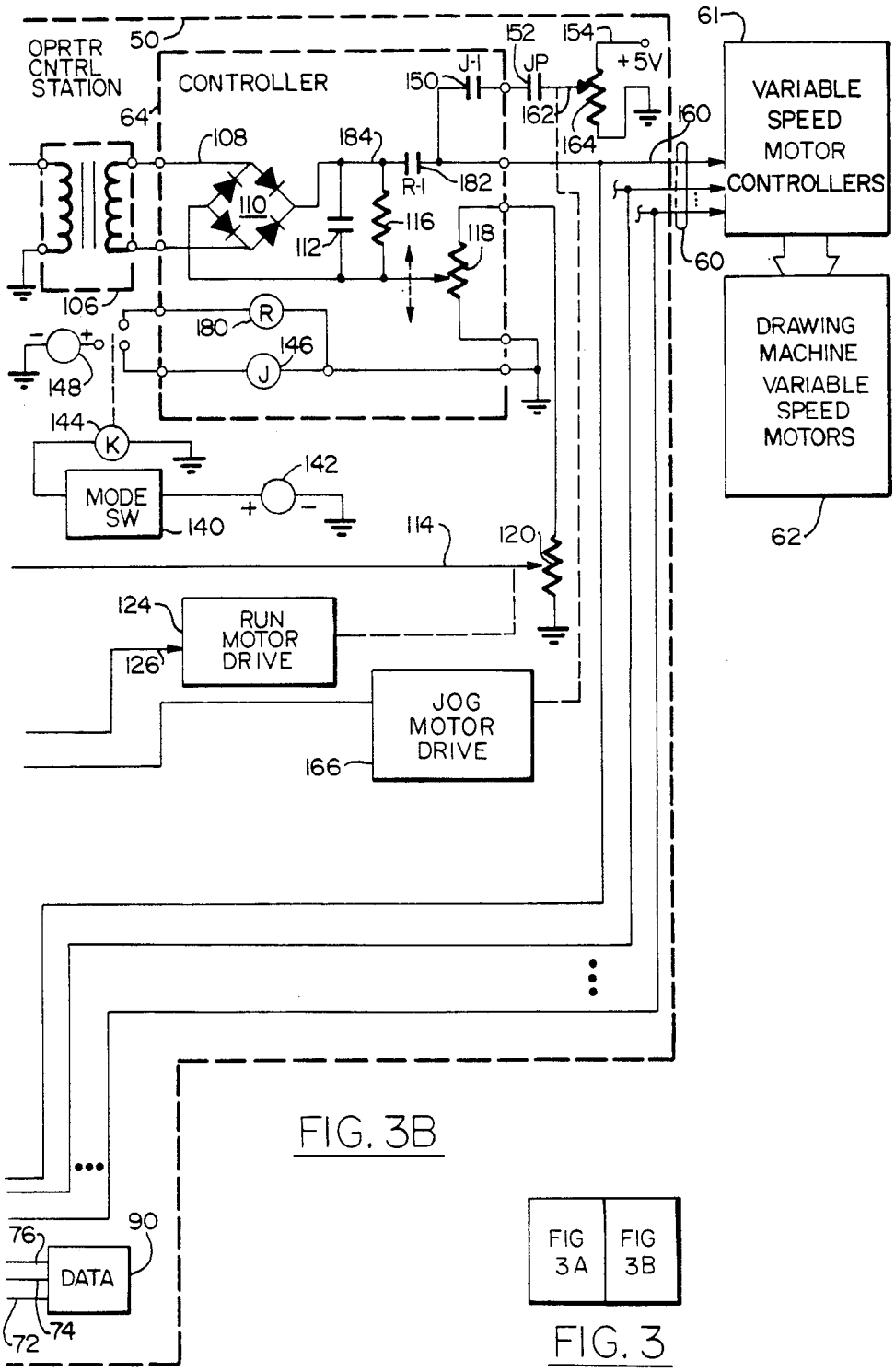

FIG. 3 is an illustration of an operator control station 50 responsive to a plurality of sensed signals on a line 52 from a corresponding plurality of accumulator sensors 54 and to a pulling capstan speed signal on a line 56 from a pulling capstan speed sensor 58 for providing a plurality of speed command signals on a line 60 to a plurality of variable speed motor controllers for in turn controlling the speeds of a corresponding plurality of variable speed motors 62 in the drawing machine 12 of FIG. 1.

The operator control station 50 includes a plurality of controllers one controller 64 of which is illustrated. Each of these controllers provides one of the plurality of speed command signals shown among the bundle of lines 60. Thus, rather than showing all of the controllers for a given operator control station only one has been illustrated for the sake of simplicity.

As mentioned, the accumulator channels may consist of a plurality of dancer arms such as shown in the accumulator 16 of FIG. 1. As such, each dancer arm will have a height sensor 42 associated therewith for measuring the height thereof. This may be accomplished by having a bicycle type chain attached to a gear on the dancer art at the pivot point thereof and also attached to another gear on a sensor such as a potentiometer or a variable transformer, such as is shown in the dancer arm height sensor 54 of FIG. 3. There, a plurality of variable transformers 66, 68, . . . 70 are illustrated providing a corresponding plurality of dancer arm height signals 72, 74, . . . 76. Each of the variable transformers is fed by a single reference signal on a line 78 from another variable transformer 80 fed by a power supply 82 and controlled by a motor drive 84. The motor drive may be driven to change the output of the variable transformer 80 either manually by means of a dancer arm "up-down" switch 86 or by means of a signal processor 88 which is responsive to an operator initiate gauge size signal and to the dancer arm height signals 72, 74, . . . 76 by means of a data path 90. The signal processor has an internal architecture which includes a random access memory (RAM) 92, a read only memory (ROM) 94, a central processing unit (CPU) 96, an input/output (I/O) unit 98, a data, control and address bus 100, and another I/O unit 102. A program is resident in the ROM 94 which may be used to control the wiper arm of the variable transformer 80 by means of the motor drive 84 according to the magnitude of a signal on a line 104 output from the signal processor for driving the motor drive 84.

One of the sensed dancer arms height signals on the line 72 will be used to explain the operation of one of the controllers 64 within the operator control station 50. That signal is provided to a transformer 106 which transforms the signal provided on line 72 and provides a transformed version thereof on a line 108 to a fullwave bridge rectifier 110. The output of the rectifier is provided to a filter capacitor 112 and the filtered output is mixed with a speed command signal on a line 114 by means of a resistor 116, a manually adjustable potentiometer 118 and a motor driven potentiometer 120.

The pulling capstan speed signal on line 56 is fed to an amplifier 122 which provides an amplified version thereof as a speed command signal on line 114. The amount of this signal which is mixed with the dancer arm height signal is determined by the position of the wiper arm on the potentiometer 120 as driven by a run motor drive 124 which receives a command signal on a line 126 from either a switch 128 or by means of an output signal on a line 130 from the signal processor 88.

There are two modes in which the drawing machine variable speed motors may be run. The first mode is a jog mode in which the operator needs to have the variable speed motors run very slowly under his direct manual control in order to assist in the threading of wire to be drawn through the machine. Mode selection is accomplished by means of a mode switch 140 supplied by a source of power 142 which provides power to a relay 144. In the jog mode the mode switch will cause the relay to be energized or not according to the type of relay contact utilized (normally opened or closed), so as to energize a relay 146 with a power supply 148. This causes a normally open contact 150 to close. A jog pedal contact 152 is controlled by an operator's foot pressure on a pedal which actuates the contact. Power is supplied from a 5 volt DC power supply 154 which provides voltage through the jog pedal contact 152 and the relay contact 150 to the particular variable speed motor controller within the controller block 61 by means of a signal line 160. The speed of the jogging motion can be controlled by changing the position of a wiper 162 on a potentiometer 164 by means of a jog motor drive 166 controlled from either a switch for manual actuation or automatically by means of the signal processor 88 over a signal line 170.

The other mode of operation is the normal run mode in which the mode switch is positioned so as to cause relay 144 to energize a relay 180 instead of the relay 146. This causes contact 150 to reopen and a normally open contact 182 to close. This permits a mixed signal on a line 184 to be provided on line 160 to an appropriate variable speed motor controller within the controller block 61.

The resistance values of the resistor 116, potentiometer 118, and potentiometer 120 are set up such that the signal on line 114 predominates. The signal on line 108, after rectification, contributes a small amount to the mixed signal on line 184 in comparison to the signal on line 114. It is in the nature of a feedback signal, although it is not a directly sensed speed signal from any corresponding variable speed motor. However, it is indication of that speed due to the height of the dancer arm being indicative thereof.

It will be understood that the signal on line 114 is utilized by all of the controller cards 64 within the operator control station 50. Thus, each of the variable speed motor controllers in the controller block 61 will receive a command signal that is conditioned by a different controller card 64 from all of the other similar controller cards in the operator control station. Thus the signal will vary slightly due to component differences. Additionally, not all of the variable speed motor controllers are operationally all nonidentical, also due to component differences. Similarly, even the motors themselves will have slight differences in response. Therefore, it will be understood that using the same command signal and different components for controlling the different motors will result in a slightly different speed in each of the different motors. This of course cannot be tolerated because of the fact that all of the wires are pulled by the same capstan at the enameling end of the process.

An ideal way to handle this problem, rather than giving a direct feedback signal, is to realize that the accumulator also needs to be regulated so as to provide each of the channels in the fabrication line with the same degree of wire accumulation. It would not do to have one wire break with all the others still intact, as this brings down the whole production line. Since the accumulation in each channel will be a direct reflection of the difference of the speeds of the capstan motor and the drawing motor, a signal indicative of that accumulation can be used as a feedback signal to close the loop in a control loop for controlling a drawing machine variable speed motor.

Thus, the signal in line 114 is a speed command signal which is essentially derived from the pulling capstan speed sensor. This is of course logical since one would wish to run both the capstan and the drawing machine motor at the same speed so that the wire does not break. However, rather than closing the loop with a feedback signal from a drawing machine variable speed motor speed sensor, a signal is instead taken from the individual accumulator channels as shown by the bundle of line 52 feeding each of the separate controllers 64, etc.

The idea is that if the command signal on the line 114 is not of sufficient magnitude to cause the motor associated with controller 64 to run at the same speed as the capstan, the accumulator signal on line 72 will be such as to augment the combined magnitudes (of the accumulator signal and the speed command signal) to bring the speed just up to where it should be. Since a slower drawing motor will be manifested in a higher dancer arm height than desired, the signal on line 72 will be appropriately scaled to take into account just where the dancer arm should be to provide the desired amount of accumulated wire to enable the production line to withstand a voltage dip in the power to the drawing machine variable speed motors.

Similarly, if the signal on line 114 is of such a magnitude that it causes the drawing machine variable speed motor associated with a particular controller card to go too fast, this will be manifested in an excess of wire in the accumulator channel and the dancer arm will be riding too low to the floor with too much wire accumulated, as compared to the rest of the dancer arms. Thus, the signal from the dancer arm variable transformer will be appropriately scaled to reduce the magnitude of the combined signals on the lines 114 and 72 (as combined on line 184). This will in turn cause the variable speed motor to slow down slightly and the excess of wire in the accumulator will be eliminated.

According to the present invention, the operator at the control station 50 may enter data via a keyboard 190 which provides input signals to the signal processor 88 via a signal line 192. Various screens may be stored in the ROM 94 for display in response to the depression of push buttons on the keyboard. A display 194 receives such signals from the keyboard and the ROM on a line 196 from the signal processor for displaying the screens.

Figure 4:
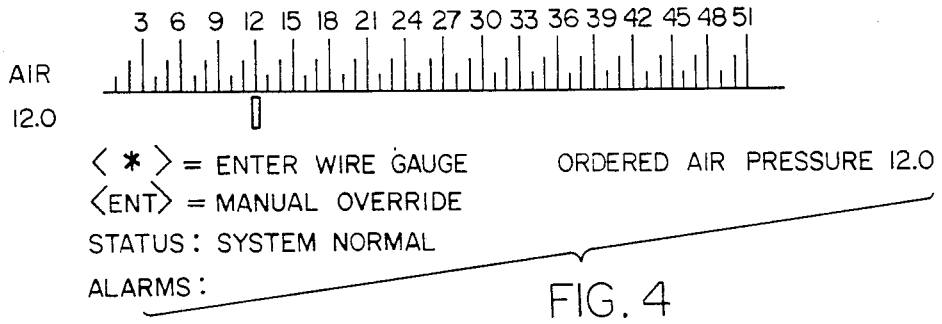
FIGS. 4 and 5 are illustrations of display screens typical of those utilized in the operator control station of FIG. 3. Best Mode For Carrying Out The Invention.

A typical screen which is displayed on the display 194 is shown in FIG. 4. This screen permits the operator to interact with the signal processor 84 by entering the desired wire gauge upon receiving a prompt from the signal processor as displayed on the display screen. After entering the desired wire gauge, in this case gauge #18, an air pressure of 12.0 is ordered and displayed.

Figure 5:
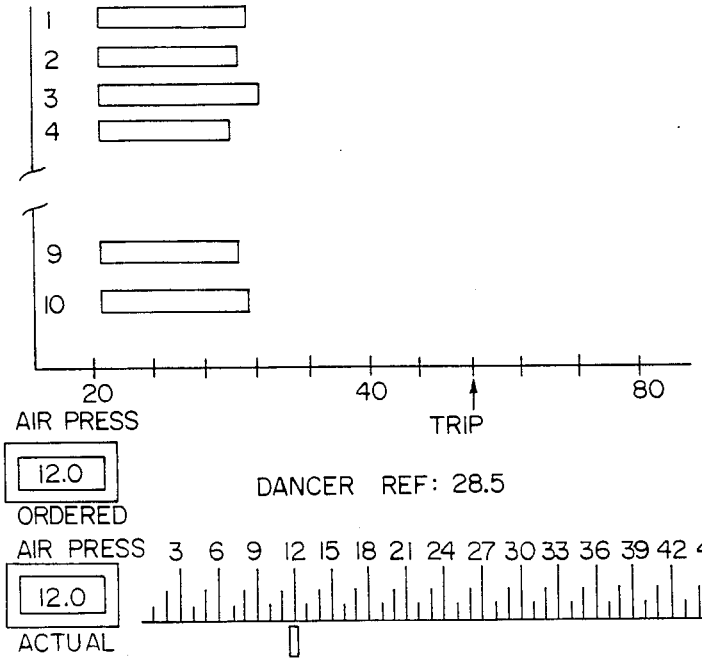

The operator can then select another screen for display such as is shown in FIG. 5. This shows the operator the response of the dancer arms to an ordered air pressure of 12 pounds. It will be noted that on the bar graph displays the heights of the various dancer arms in the various corresponding fabrication lines. Each has a height which is close to a reference height of 28.5 (arbitrary units). The ordered and actual air pressures are also displayed.

Although the invention has been shown and described with respect to a best mode embodiment thereof, it should be understood by those skilled in the art that the foregoing and various other changes, omissions, and additions in the form and detail thereof maybe made therein without departing from the spirit and scope of the invention.

We claim:

1. Apparatus, for controlling the speeds of a plurality of variable speed motors according to the magnitudes of a motor drive speed control signal, a reference signal and an operator input gauge size signal, for drawing a plurality of wires to a gauge size indicated by the gauge size signal, the apparatus for controlling the motors in a corresponding plurality of fabrication lines, having an accumulator including a corresponding plurality of wire accumulator channels for accumulating wire from the motors and having an independently driven capstan for pulling the drawn wires from the accumulator, the apparatus further comprising:

a plurality of sensors, responsive to the reference signal and to the quantity of wire accumulated in each accumulator channel for providing a corresponding plurality of accumulation signals each having a magnitude equal to the reference signal magnitude augmented by a signal magnitude indicative of the quantity of wire accumulated in a corresponding channel;

a sensor, responsive to the speed of the pulling capstan for providing a capstan speed signal having a magnitude indicative of the speed of the pulling capstan for commanding the speed of the motors; and an operator control station, comprising:

a plurality of controllers, each responsive to a selected one of said accumulation signals and to said capstan speed signal for providing a motor drive speed control signal for commanding the speed of a corresponding one of the variable speed motors according to the magnitude of said capstan speed signal modified by said selected accumulation signal so as to increase the speed of said motor to a speed greater than that indicated by the magnitude of said capstan speed signal in response to an accumulation signal magnitude indicative of an accumulation of wire less than a selected amount and modified so as to decrease the speed of said motor to a speed lesser then that indicated by the magnitude of said capstan speed signal in response to an accumulation signal magnitude indicative of an accumulation of wire greater than a selected amount;

a keyboard for entering a gauge size and for providing said gauge size signal;

a display responsive to the gauge size signal for displaying the magnitude thereof; and signal processor means, responsive to the gauge size signal for controlling the amount of accumulation of wire in the accumulator channels by controlling the magnitude of the reference signal.

* * * * *